US010772365B2

(12) United States Patent
McAndrew

(10) Patent No.: US 10,772,365 B2
(45) Date of Patent: Sep. 15, 2020

(54) CONVERTIBLE GARMENT

(71) Applicant: Jean Bloomfield McAndrew, Nokomis, FL (US)

(72) Inventor: Jean Bloomfield McAndrew, Nokomis, FL (US)

( * ) Notice: Subject to any disclaimer, the term of this patent is extended or adjusted under 35 U.S.C. 154(b) by 107 days.

(21) Appl. No.: 15/264,159

(22) Filed: Sep. 13, 2016

(65) Prior Publication Data

US 2018/0070661 A1 Mar. 15, 2018

(51) Int. Cl.
*A41D 15/00* (2006.01)
*A41D 31/00* (2019.01)
*A41D 3/08* (2006.01)

(52) U.S. Cl.
CPC ..... *A41D 15/00* (2013.01); *A41D 3/08* (2013.01); *A41D 31/00* (2013.01)

(58) Field of Classification Search
CPC ..... A41D 3/08; A41D 15/00; A41D 7/008; A41D 31/00
USPC ..... 2/88, 207
See application file for complete search history.

(56) References Cited

U.S. PATENT DOCUMENTS 1,511,737 A * 10/1924 Lord ..... A45D 44/08 2/50
1,705,963 A 3/1929 Clawson
1,906,846 A * 5/1933 Finger ..... A41D 23/00 2/91
2,423,392 A * 7/1947 Name Not Available ..... A41B 13/06 128/873
2,652,052 A * 9/1953 Smith ..... A41B 13/06 128/873
2,668,293 A * 2/1954 Levy ..... A41D 1/18 2/105
2,669,721 A 2/1954 Koch
2,808,591 A * 10/1957 Grant ..... A41D 3/08 2/88
2,825,905 A 3/1958 Merl
4,117,840 A * 10/1978 Rasure ..... A61F 5/3784 128/874
5,315,712 A * 5/1994 McTaggart ..... A41D 27/00 2/105
5,625,897 A * 5/1997 Park ..... A41B 13/10 2/69
8,468,612 B1 6/2013 Galloway
2009/0126070 A1 5/2009 Lee
2012/0284893 A1 * 11/2012 Sohn ..... A41D 1/215 2/46

* cited by examiner

*Primary Examiner* — Alissa L Hoey
*Assistant Examiner* — Catherine M Ferreira
(74) *Attorney, Agent, or Firm* — Larson & Larson, P.A.; Frank Liebenow; Justin P. Miller

(57) ABSTRACT

A garment includes a panel of material having an outer edge and a main opening. A slit is formed (e.g., cut) in the panel of material. An open end of the slit interfaces to the main opening and a closed end of the slit ends between the main opening and the outer edge of the panel. The slit is configured to be tied where the slit meets the main opening to adjust a size of the main opening so that the garment is wearable in various configurations including being warn as a poncho or a cape.

2 Claims, 8 Drawing Sheets

CONVERTIBLE GARMENT

FIELD

This invention relates to the field of clothing and more particularly to a garment that adjusts for various wearing uses and styles.

BACKGROUND

There exist many scarfs, shawls, and capes, each having certain design, shapes, coloring, patterns, etc., to provide a given look or style to a person wearing such items. These items are typically single-purpose; as a scarf is not worn as a cape or a shawl, etc.

Closed garments typically have a fixed-sized opening of a certain size, for example, a head opening for a poncho. Having a fixed sized opening, such garments do not permit conversion between many different styles.

What is needed is a garment that is adjustable so that it can be worn as a cape, toga, cowl, shawl, etc.

SUMMARY

A garment is disclosed that includes a panel of material having at least one main opening through which a person's head will fit. The material includes a partial slit (e.g., the slit does not bifurcate the panel of material) emanating from the main opening, providing a main opening that has an adjustable size (e.g. diameter) by way of knotting the partial slit to allow for donning the garment over different locations of the person's body such as in the neck area or chest area. Fitting over the chest area, the garment is then convertible into a cape by pulling the front of the garment over the wearer's head.

In one embodiment, a garment is disclosed including a panel of material having an outer edge and a main opening. A slit is formed in the panel of material. An open end of the slit interfaces to the main opening and a closed end of the slit ends between the main opening and the outer edge of the panel. The slit is configured to be tied where the slit meets the main opening to adjust a size of the main opening so that the garment is wearable in various configurations.

In another embodiment, a method of wearing a garment is disclosed. The garment has a panel of material with an outer edge and a main opening. A slit is formed in the panel of material with an open end interfaced to the main opening and a closed end ending between the main opening and the outer edge. The method of wearing includes tying a knot in the garment where the slit is interfaced to the main opening and pulling the garment over one's head, thereby donning the garment around one's neck, similar to a poncho. Later, holding an edge of the opening and pulling the front portion of the garment over the head, thereby converting the garment into a cape.

In another embodiment, a garment is disclosed including a panel of material having a substantially round outer edge and a substantially round and centered main opening. The panel has a slit formed there within. An open end of the slit interfaced to the main opening and a closed end of the slit ends between the main opening and the outer edge of the panel. The slit is configured to be tied where the slit meets the main opening to adjust a size of the main opening so that the garment is wearable in various configurations.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
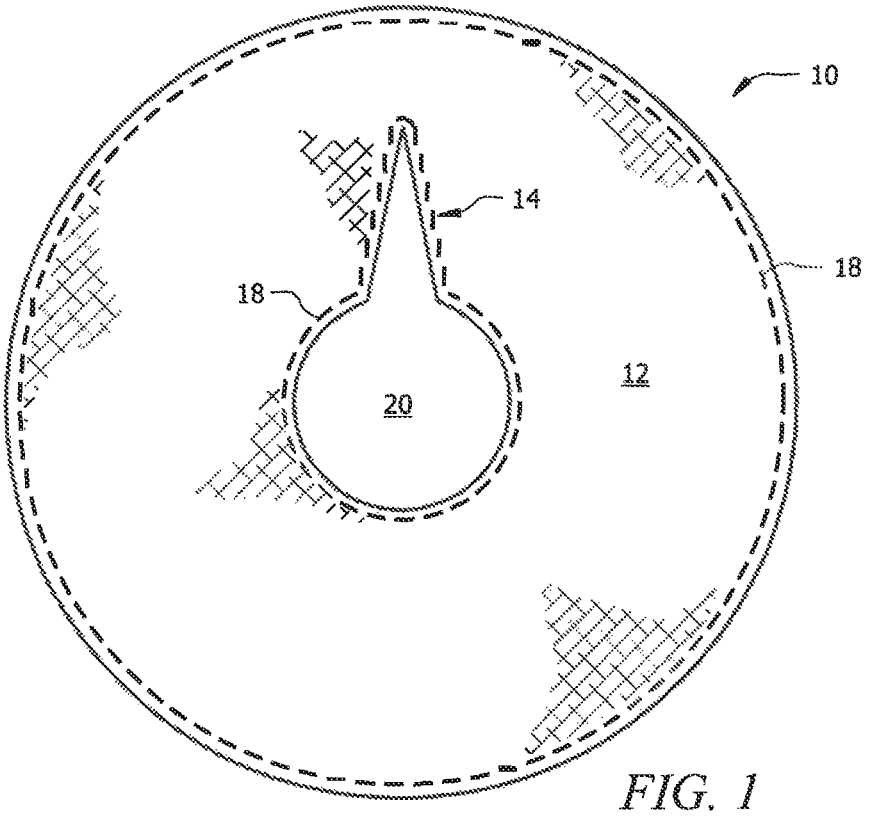
FIGS. 1 and 2 illustrate plan views of a garment having a circular outer shape.

Reference will now be made in detail to the presently preferred embodiments of the invention, examples of which are illustrated in the accompanying drawings. Throughout the following detailed description, the same reference numerals refer to the same elements in all figures.

Throughout this description, the garment is made of any suitable material. As an example the garment is made of a cloth material having resilient properties so as to be able to stretch, for example, to stretch over a person's shoulders, waist, etc. In some embodiments, the material is a sheer fabric so as to be easily tied, as will be shown. It is fully anticipated that the garment be colored, textured, printed, dyed, etc., to provide a suitable look as desired.

Figure 2:
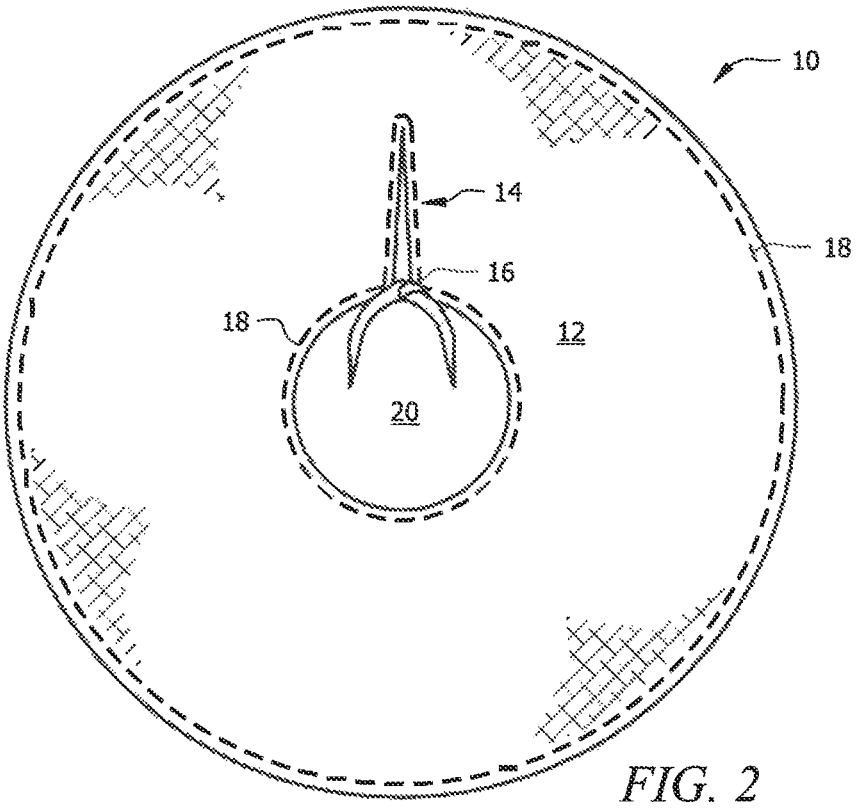
Figure 3:
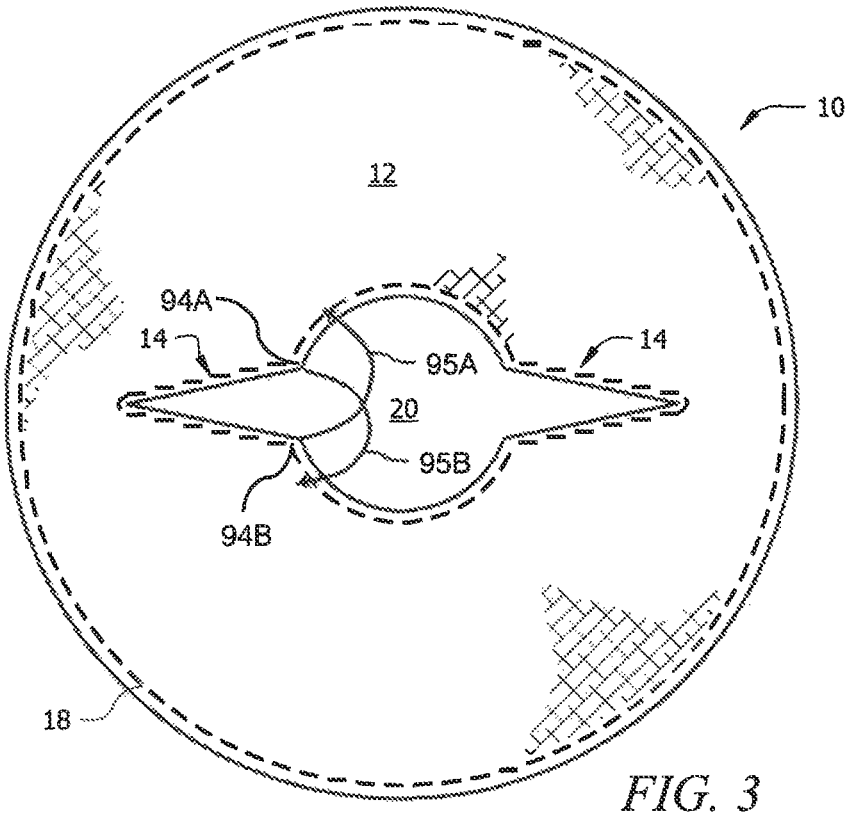
FIG. 3 illustrates a plan view of the garment having a circular outer shape with dual slits.

Referring to FIGS. 1, 2, and 3, plan views of a garment 10 having rounded outer shapes are shown. In FIGS. 1 and 2, the garment 10 has an entirely circular outer shape and is made of a monolithic sheet of material (e.g. not comprising separate pieces of material) with a single slit 14. In FIG. 3, the garment 10 has an entirely circular outer shape and is made of a monolithic sheet of material (e.g. not comprising separate pieces of material) with dual slits 14. Each point 94A/94B at an end of a slit 14 is independently capable of being tied by stretching a first point 94A of the slit 14 over the second point 94B of the slit 14 as indicated by arrows 95A and 95B. The resulting tied points 94A/94B are shown in FIGS. 8, 9, 10, and 11.

The garment 10 is fabricated to wear in many different configurations; thereby the garment 10 is adjustable to suit the style of the wearer. The garment 10 consists of a panel of material 12 that in the embodiments of FIGS. 1-3 is generally round (FIGS. 1 and 2) or oval (FIG. 3). The garment 10 has at a main opening 20 that has a slit 14 for adjusting the size of the main opening 20. Although any suitable material is anticipated for the panel of material 12, a sheer fabric is preferred so that the wearer is able to tie the panel of material 12 where the slit 14 meets the main opening 20, thereby adjusting the size of the main opening 20 for wearing the garment 10 in several different modes. For example, the wearer ties the panel of material 12 where the slit 14 meets the main opening 20 and dons the garment 10 over their head, similar to a poncho. The description of FIGS. 8-15 shows how the garment 10 is worn in various other modes through the use of the adjustable main opening 20.

In some embodiments, the slit 14 if made/formed by cutting the panel of material 10 and, in some embodiments, the cut, as well as the edge of the main opening 20 is edged, for example, a surged edge.

In FIG. 2, it is shown how the panel of material 12 is tied into a knot 16 where the slit 14 meets the main opening 20, thereby reducing the overall dimensions of the main opening 20.

Although the main opening 20 is shown as being generally round, any shape of main opening 20 is anticipated, for example, a generally oval shaped main opening 20.

The panel of material 12 is made of a fabric, for example, a sheer fabric. As such fabrics tend to unravel, in some embodiments the panel of material 12 is hemmed with stitching 18 or any known finishing (e.g. a surged edge) is used to prevent the edges of the material 12 from fraying or unraveling.

Figure 4:
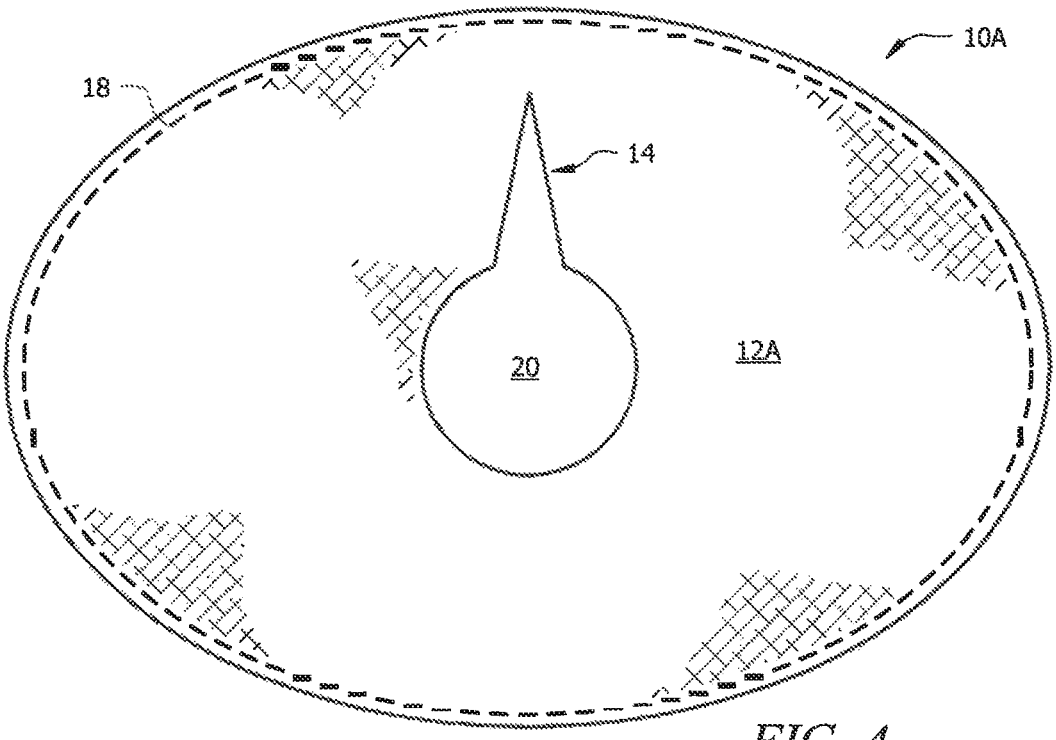
FIG. 4 illustrates a plan view of the garment having an oval outer shape.
Figure 5:
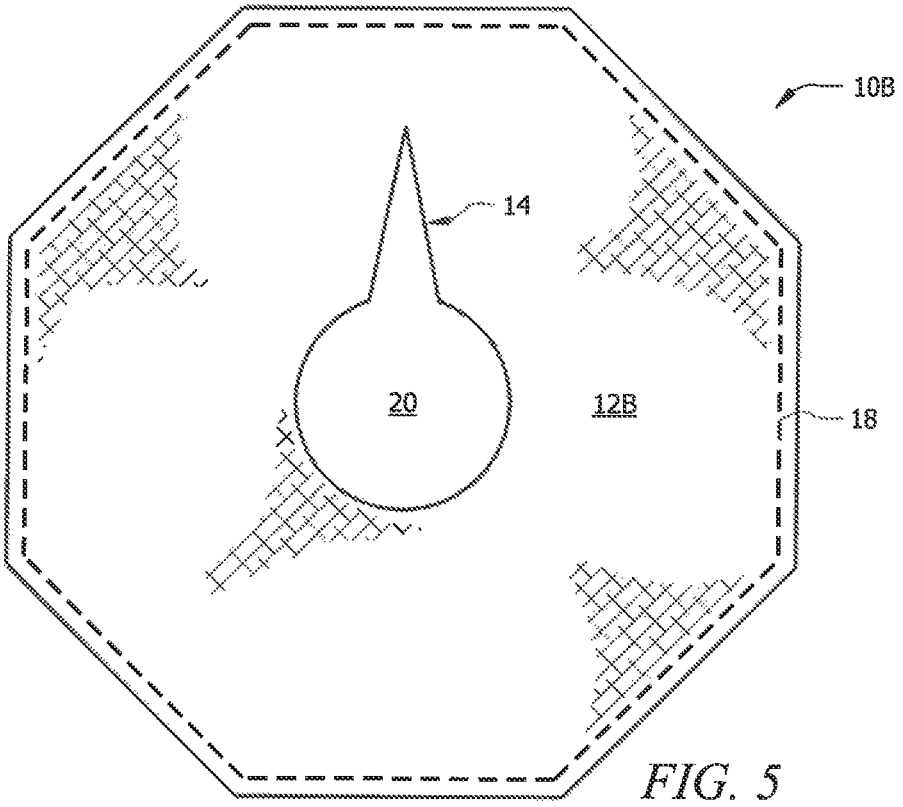
FIG. 5 illustrates a plan view of the garment having an octagonal outer shape.

Referring to FIGS. 4 and 5, plan views of the garment 10 having various outer shapes are shown. In FIG. 4, the garment 10A is shown having an oval outer shape. In FIG. 5, the garment 10B is shown having an octagonal outer shape.

Although shown in round, oval and octagonal shapes, there is no limitation as to the outer shape of the panel 12 as well as the shape of the main opening 20 and/or any other optional openings of the garment 10. The overall shape of the garment 10 is anticipated, but in no way limited to, oval, rectangular, square, triangular, octagonal, hexagonal, etc. In some embodiments, the overall shape of the garment 10 is regular and symmetrical and in some embodiments, asymmetrical.

The garment 10A/10B is fabricated to wear in many different configurations; thereby the garment 10A/10B is adjustable to suit the style of the wearer. The garment 10A/10B consists of a panel of material 12 that in the embodiments of FIGS. 4 and 5 is generally oval (FIG. 4) or octagonal (FIG. 5). The garment 10A/10B has at a main opening 20 that has a slit 14 for adjusting the size of the main opening 20. Although any suitable material is anticipated for the panel of material 12A/12B, a sheer fabric is preferred so that the wearer is able to tie the panel of material 12A/12B where the slit 14 meets the main opening 20, thereby adjusting the size of the main opening 20 for wearing the garment 10A/10B in several different modes. For example, the wearer ties the panel of material 12A/12B where the slit 14 meets the main opening 20 and dons the garment 10A/10B over their head, similar to a poncho. The description of FIGS. 7-14 shows how the garment 10A/10B is worn in various other modes through the use of the adjustable main opening 20.

Again, although the main opening 20 is shown as being generally round, any shape of main opening 20 is anticipated, for example, a generally oval shaped main opening 20.

As said, the panel of material 12A/12B is made of a fabric, for example, a sheer fabric. As such fabrics tend to unravel, in some embodiments the panel of material 12 is hemmed with stitching 18 or any known finishing is used to prevent the edges of the material 12 from fraying or unraveling (e.g. a surged edge).

Figure 6:
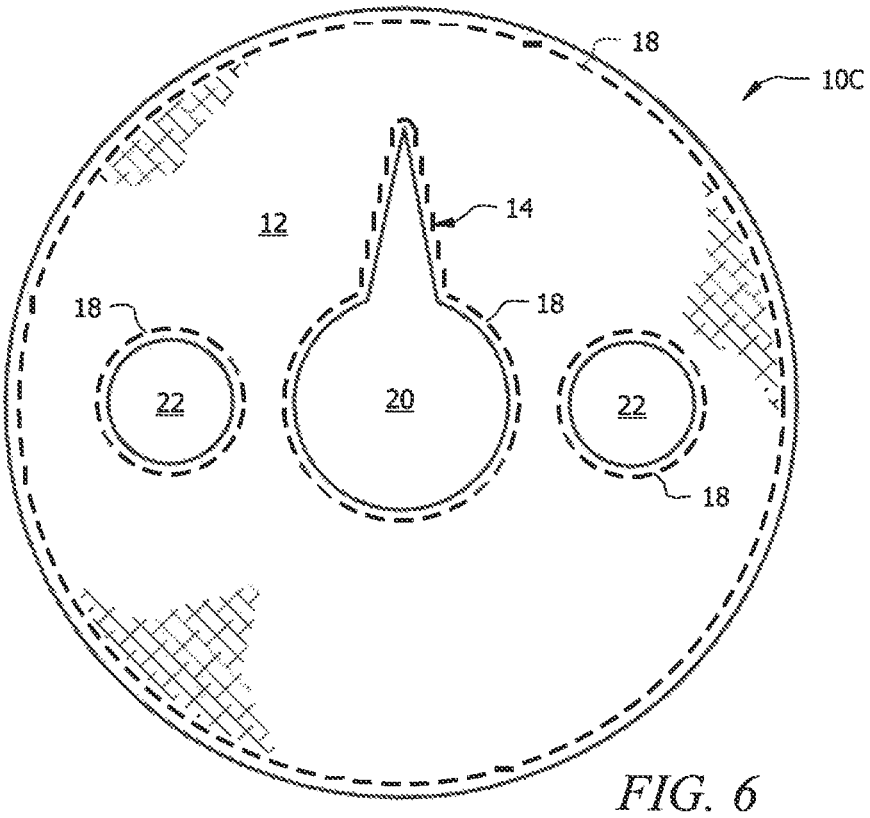
FIGS. 6 and 7 illustrate plan views of the garment having a circular outer shape with arm openings.
Figure 7:
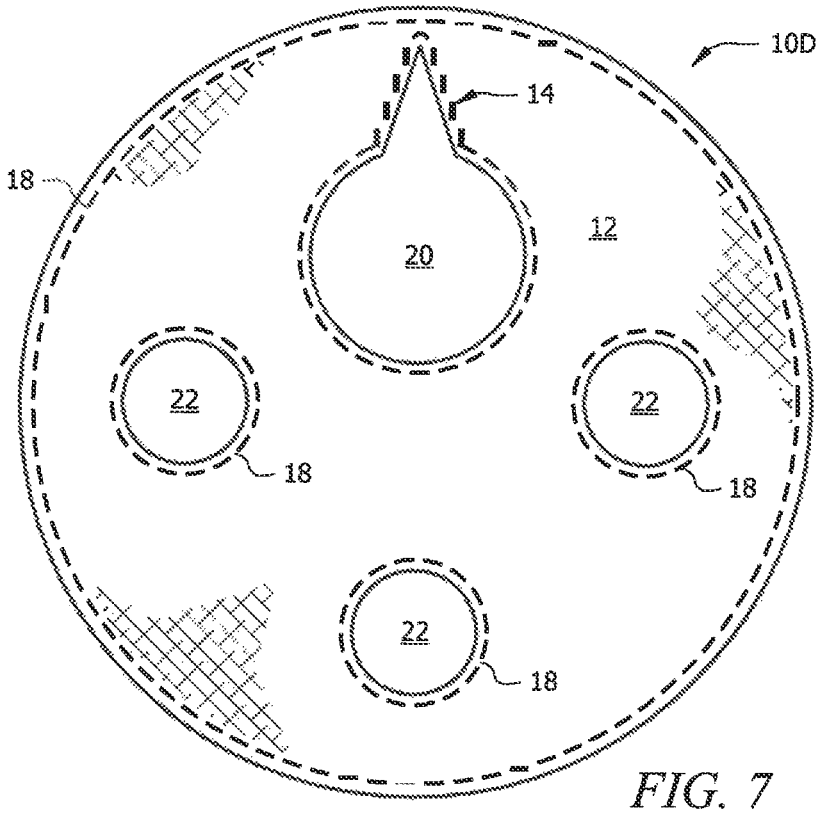

Referring to FIGS. 6 and 7, plan views of the garment 10C/10D are shown with auxiliary openings 22 (e.g. arm openings). The garment 10C/10D is fabricated to wear in many different configurations; thereby the garment 10C/10D is adjustable to suit the style of the wearer. The garment 10C/10D consists of a panel of material 12 that in the embodiments of FIGS. 6 and 7 is generally round. The garment 10C/10D has at a main opening 20 that has a slit 14 for adjusting the size of the main opening 20. Although any suitable material is anticipated for the panel of material 12, a sheer fabric is preferred so that the wearer is able to tie the panel of material 12 where the slit 14 meets the main opening 20, thereby adjusting the size of the main opening 20 for wearing the garment 10C/10D in several different modes. For example, the wearer ties the panel of material 12 where the slit 14 meets the main opening 20 and dons the garment 10C/10D over their head, similar to a poncho. The description of FIGS. 7-14 shows how the garment 10C/10D is worn in various other modes through the use of the adjustable main opening 20.

Although the auxiliary openings 22 are shown being round, any shape of auxiliary opening 22 is anticipated (e.g. oval). It is further anticipated that, in some embodiments, the auxiliary openings 22 also have slits 14 (not shown for clarity purposes), making the auxiliary openings 22 adjustable, like the main opening 20.

Although the main opening 20 is shown as being generally round, any shape of main opening 20 is anticipated, for example, a generally oval shaped main opening 20. Further, as shown in FIG. 7, the location of the main opening 20 can be at any location on the material 18 as long as the outer edge of the material 18 is closed.

As said, the panel of material 12 is made of a fabric, for example, a sheer fabric. As such fabrics tend to unravel, in some embodiments the panel of material 12 is hemmed with stitching 18 or any known finishing is used to prevent the edges of the material 12 from fraying or unraveling (e.g. a surged edge).

Figure 8:
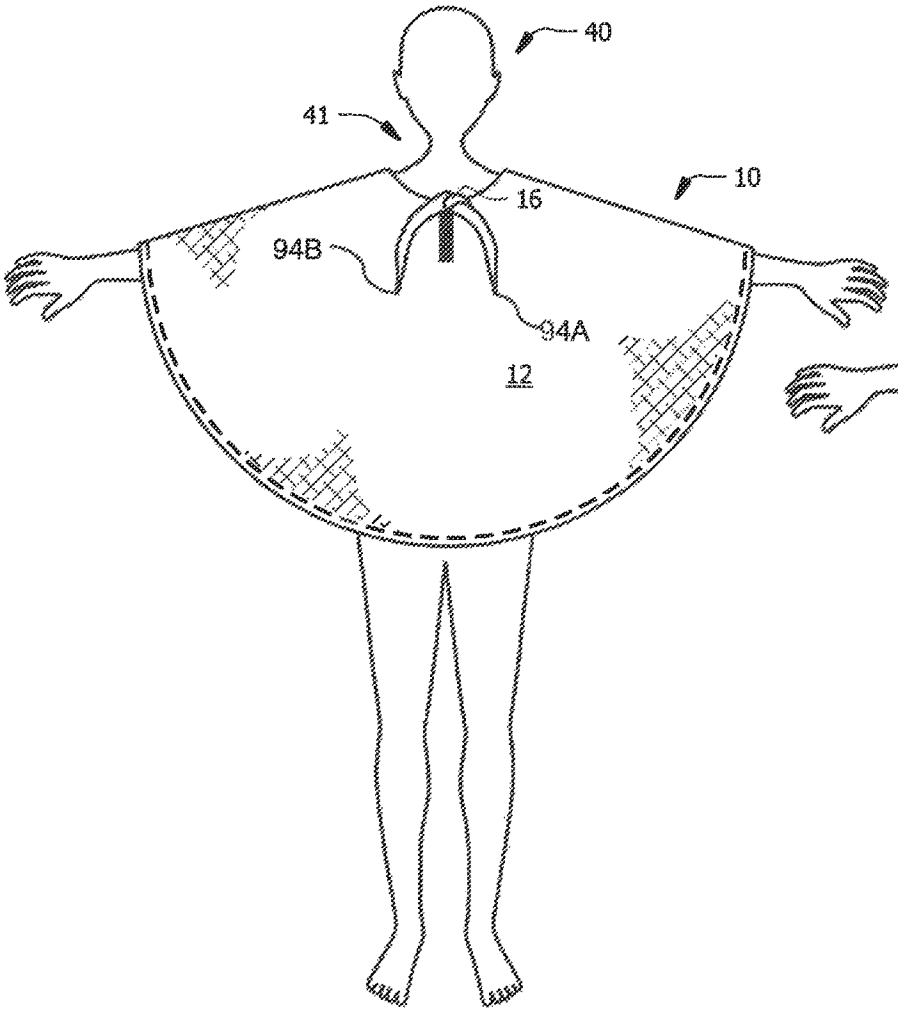

Referring to FIGS. 8-15, perspective views of the garment 10 are shown transitioning into a cape. In FIG. 8, the garment 10 is shown being worn by a person 40 around the person's neck 41, similar to a poncho. In this mode of wearing, the knot 16 is tied in the panel of material 12 where the slit 14 meets the main opening 20, as the main opening 20 fits over the head of the person 40. Otherwise, the main opening 20 is too large and may fall down over the shoulders of the wearer.

Figure 9:
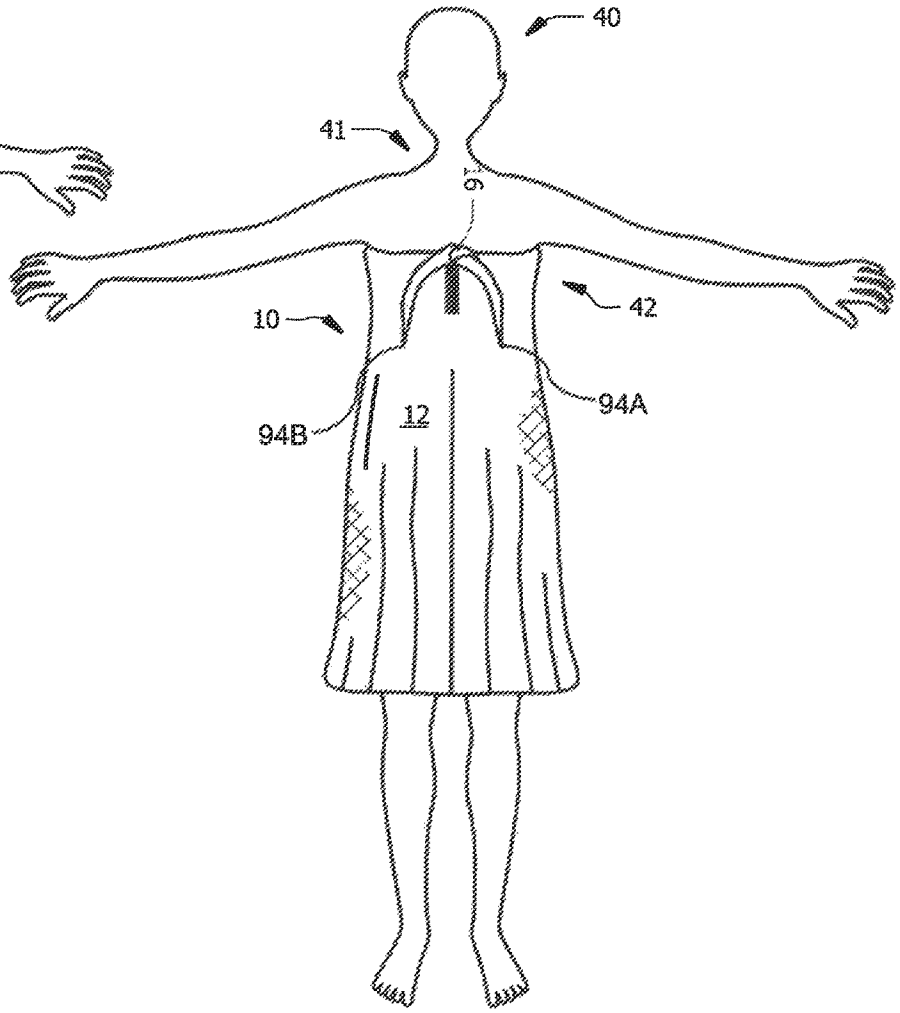
FIGS. 8-15 illustrate perspective views of the garment transitioning into a cape.

In FIG. 9, the knot 16 tied in the panel of material 12 where the slit 14 meets the main opening 20 has been re-adjusted to increase the size of the main opening 20. It is also anticipated that the slit 14 be left untied during donning as a cape. Being adjustable in size, the main opening 20 provides a large enough opening as to fit over the upper torso 42 of the person 40. In some embodiments, this is further aided by the material 12 having a certain amount of resiliency as do many sheer fabrics. By using such resilient materials, the main opening 20 is easier to pull over the greater dimensions of the person's shoulders.

Figure 10:
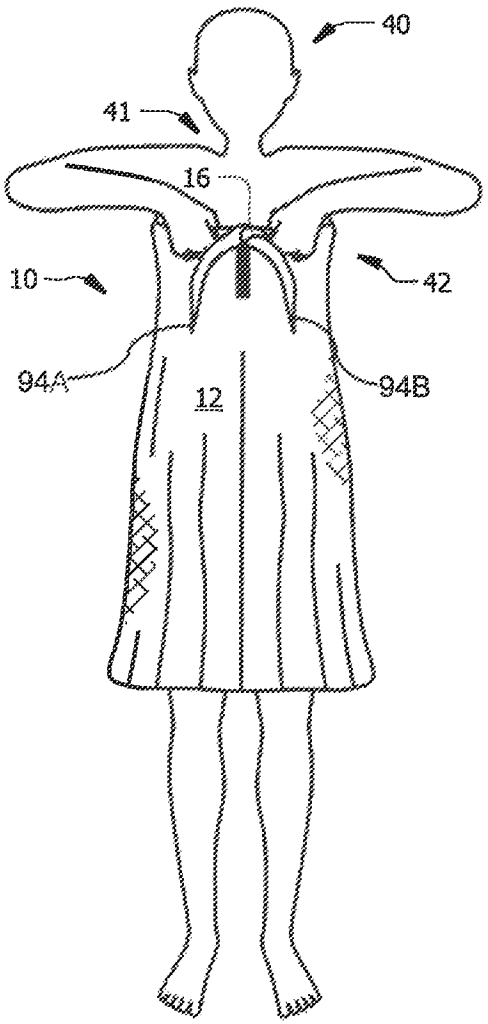

In FIG. 9, the main opening 20 is brought over the torso of the person 40. In FIG. 10, the person 40 grasps the edges of the main opening 20. In this view, only the top surface of the panel 12 is visible.

Figure 11:
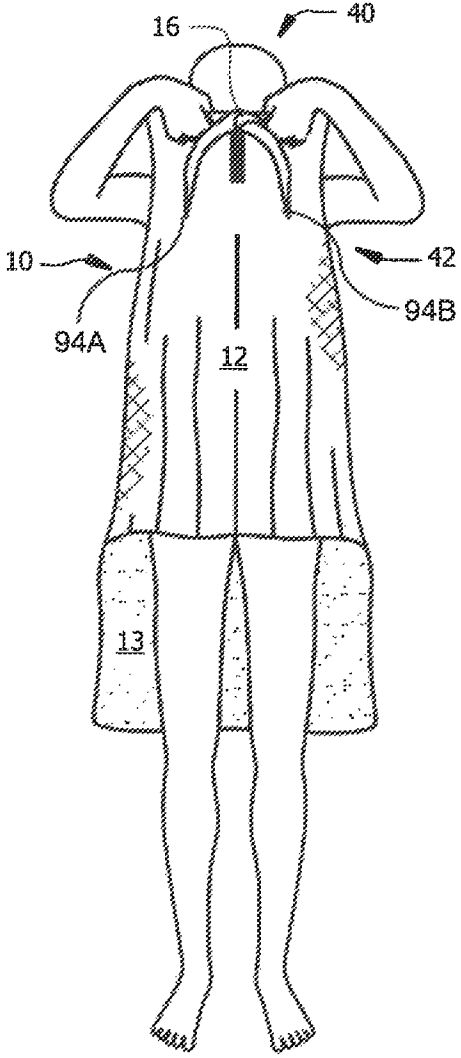
Figure 13:
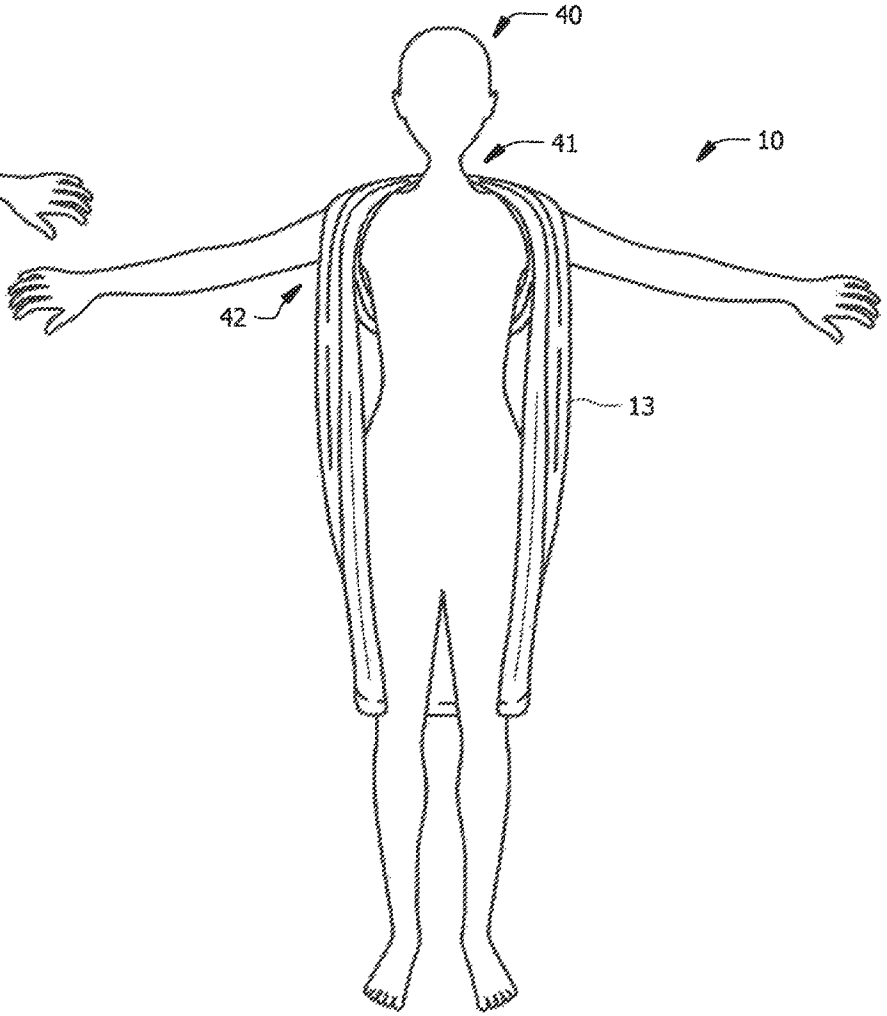
Figure 12:
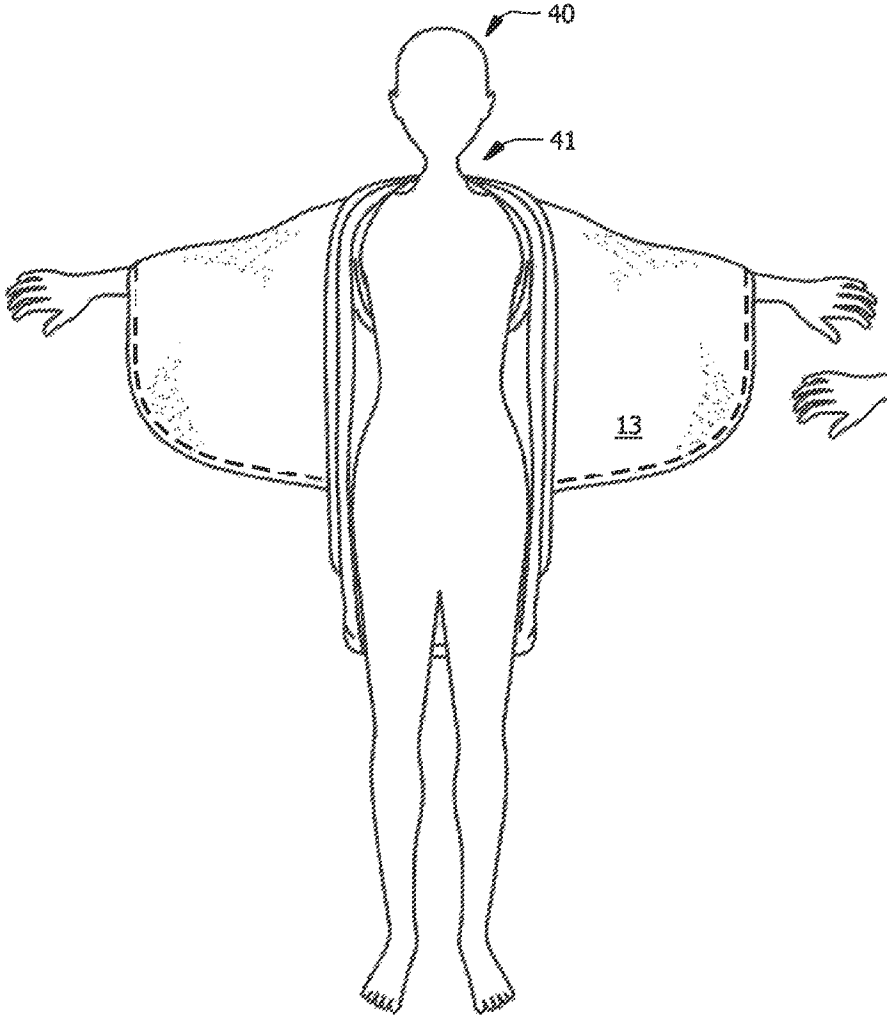

In FIG. 11, the person 40 tucks their head and pulls the main opening 20 over their head. Note that the reverse side 13 of the paned 12 is visible. In FIG. 12, the garment 10 is shown transitioned into a cape. FIG. 13 shows the same cape, with the sleeve area bunched for a slightly different look.

Figure 15:
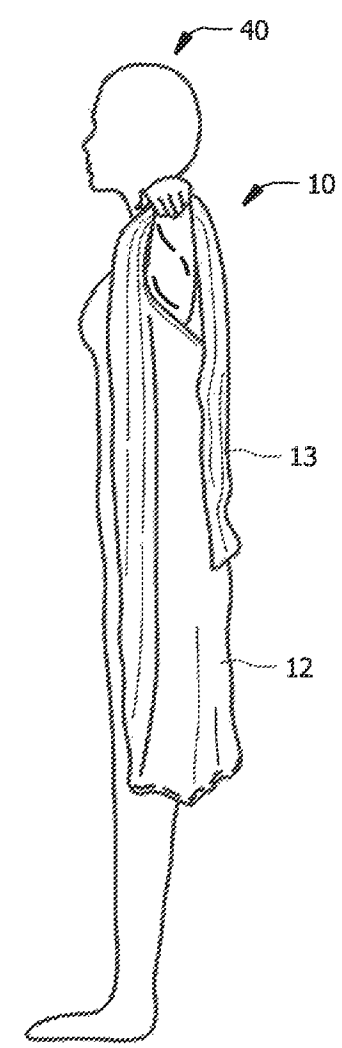
Figure 14:
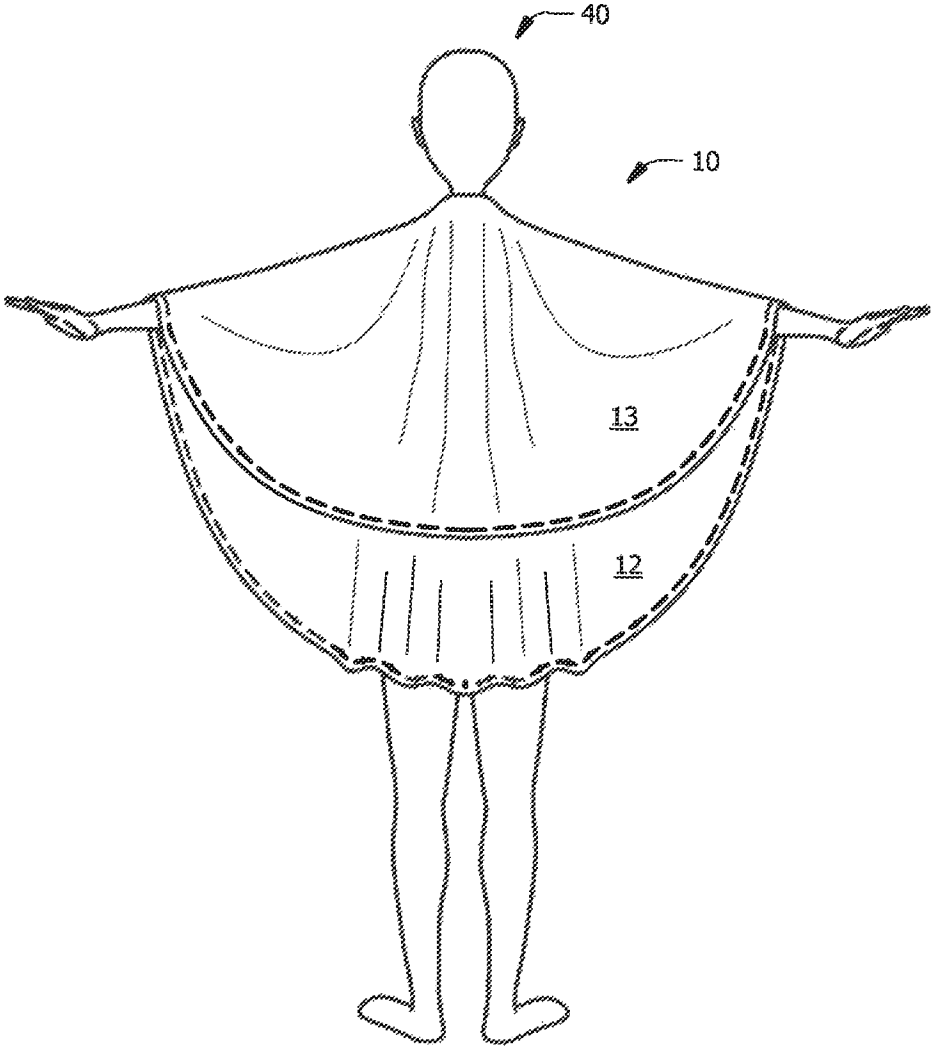

In FIG. 14, the back of the person 40 is shown with the inside surface 13 of the panel 12 now on the outside of the back of the person 40. In FIG. 15, a side view of the person 40 is shown, highlighting the cape style of the garment 10.

Although the slit 14 is shown using a knot 16 to change the size of the main opening 20, it is equally anticipated to use various fasteners to adjust the size of the main opening.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A garment consisting of:

a monolithic panel of material having an outer edge that is entirely round and having a main opening that is centered in the monolithic panel of the material; and the main opening has two slits on opposite sides of the main opening, each of the slits consisting of two linear edges; a first end of each of the linear edges connect to a corresponding arc-shaped edge of the main opening and a distal end of the linear edges converge and meet at a point spaced from the outer edge of the monolithic panel of the material;

whereas the monolithic panel of material is continuous except for the main opening and the slits;

whereas the panel of material is seamless;

whereas the material ties at a location in the material where the first end of each of the linear edges connects to the corresponding arc-shaped edge of the main opening; the main opening is sized for fitting over a user's shoulders; and whereas the garment converts from one configuration worn as a shawl to a second configuration worn as a cape.

2. The garment of claim 1 the material is a sheer material.

* * * * *